US012209424B2

(12) United States Patent
Dunham

(10) Patent No.: US 12,209,424 B2
(45) Date of Patent: Jan. 28, 2025

(54) POLE PROTECTOR

(71) Applicant: Sean Dunham, Lake Elmo, MN (US)

(72) Inventor: Sean Dunham, Lake Elmo, MN (US)

( * ) Notice: Subject to any disclaimer, the term of this patent is extended or adjusted under 35 U.S.C. 154(b) by 0 days.

(21) Appl. No.: 17/839,126

(22) Filed: Jun. 13, 2022

(65) Prior Publication Data

US 2022/0396958 A1 Dec. 15, 2022

Related U.S. Application Data

(60) Provisional application No. 63/210,060, filed on Jun. 13, 2021.

(51) Int. Cl.
*E04G 23/02* (2006.01)
*E04H 12/22* (2006.01)

(52) U.S. Cl.
CPC ..... *E04G 23/02* (2013.01); *E04H 12/2292* (2013.01)

(58) Field of Classification Search
CPC ..... E04H 12/2292; E04G 23/02
See application file for complete search history.

(56) References Cited

U.S. PATENT DOCUMENTS

| | | | | |
|---|---|---|---|---|
| 405,658 | A * | 6/1889 | Campany | E04H 12/2292 52/170 |
| 4,516,365 | A * | 5/1985 | Chapman | E04H 12/2292 52/514 |
| 4,598,512 | A * | 7/1986 | Chapman | E04H 12/2292 52/165 |
| 4,817,346 | A * | 4/1989 | Westgard | E04H 12/2292 52/168 |
| 7,556,752 | B1 * | 7/2009 | Hicks | E02D 27/42 249/165 |
| 9,140,024 | B2 * | 9/2015 | Gable | E04G 23/00 |
| 9,416,556 | B2 * | 8/2016 | Gable | E04C 3/30 |
| 9,574,365 | B2 * | 2/2017 | Catt | A01G 17/14 |
| 9,650,803 | B1 * | 5/2017 | Bartels | E02D 29/127 |
| 9,771,734 | B2 * | 9/2017 | Odegard | E04H 12/2292 |
| 9,903,089 | B2 * | 2/2018 | Bartels | E02D 29/1427 |
| 10,480,207 | B1 * | 11/2019 | Webster | E04H 12/2292 |
| 10,655,356 | B2 * | 5/2020 | Odegard | E04H 12/2292 |
| 2009/0266026 | A1 * | 10/2009 | Hannay | E04H 12/2292 52/745.17 |
| 2016/0319563 | A1 * | 11/2016 | Gable | E04G 23/00 |
| 2018/0179724 | A1 * | 6/2018 | Bartels | E02D 29/1481 |
| 2022/0396958 | A1 * | 12/2022 | Dunham | E04G 23/02 |

* cited by examiner

*Primary Examiner* — Andrew J Triggs
(74) *Attorney, Agent, or Firm* — Pauly, DeVries Smith & Deffner LLC

(57) ABSTRACT

The present application is directed to a protective cover for a utility pole comprising: a first protective portion; and a second protective portion; wherein the first and second protective portions are each substantially hemispherical and combine to surround and protect a pole at the ground interface.

2 Claims, 11 Drawing Sheets

POLE PROTECTOR

This application claims the benefit of U.S. Provisional Application No. 63/210,060, filed Jun. 13, 2021, the content of which is herein incorporated by reference in its entirety.

FIELD

Embodiments herein relate to protective devices for poles.

BACKGROUND

Electrical and communications poles provide residential communities, cities and businesses with the necessary infrastructure such as lighting, signals, communications networks and other technologies while also providing an easy access point for utility, contractor, government and communication workers to make repairs as needed. The poles can be made of various materials, including composite, other fiber-resin composites, wood, etc. Often, these electrical and communication poles are installed buried or embedded into the ground. The composite or wood pole provides a mountable infrastructure that is required to support the lighting, signals, communications networks and other technologies. However, because part of the composite or wood pole remains above ground, the base is vulnerable to damage. Often, the base of the composite or wood poles are damaged by mowers, tractors, weed trimmers, shovels, and the like. Thus, it is often desirable to have both above-ground and below-ground protection.

Any structural breaks or damage in the composite or wood poles can inhibit the performance, reliability, and safety of the electrical and communication infrastructure mounted to or on them. This is because once a structural break occurs, animals, unqualified persons, children, dust, water, and dirt can all access the equipment stored in the electrical and communication boxes. And weakening the base of the composite or wood poles can allow wind to blow them over, taking down the lighting, communications, signals or the like. This is dangerous to a community from the perspective of a pedestrian or driver not being able to see, losing a communication signal, or dropping GPS location, but can also cause significant damage to whatever the pole may fall upon.

Presently, when a composite or wood pole is damaged, utility, contractor, government and communication workers must dig up the ground around the pole to fully expose the damaged portion and likely replace the entire structure. Very rarely can these be patched or sealed, and still maintain their structural integrity. This method of maintenance of poles is reactionary in nature and increases the costs associated with the pole and anything that may be mounted to or upon them.

SUMMARY

In a first aspect, a protective cover for a utility pole is included having a first protective portion, and a second protective portion, wherein the first and second protective portions are each substantially hemispherical and combine to surround and protect a pole at the ground interface.

In a second aspect, in addition to one or more of the preceding or following aspects, or in the alternative to some aspects, wherein each of the first and second protective portions include lower portions containing points, the points configured for driving into the ground to secure the first and second protective portions in the ground. Thus, the present design includes a two-piece clamshell or coupling design, that is installed at/on the base of composite or wood pole directly embedded/buried in the ground. Full install has the bottom half or shovel blades below the groundline.

Thus, the design includes a two-piece coupling design on either side of the pole. The two-piece design can include slots where cable ties can secure/pull together the clamshells for securement on the pole. Also, a nail head/hammer point/peg for stomping with a boot to press the shovel blade into the ground. A slot where an additional plastic piece can slide in to provide full circumference coverage of the pole when a pole size may be larger than the two clamshells, therefore they can't touch edges.

A tapered edge that works to force the guard up against and along side the pole as it is pressed into the ground. One piece, that mirrors itself to create a full clamshell/coupling pole guard. Cable tie slots. Wider than width of cable tie so it can be range taking in the event that the two pieces cannot be installed to the exact perfect matching depth/height. There can be a small outset area gap, that allows an additional plastic rectangular shape/plaque to be added when the pole size exceeds the ability of the two clamshells/couplings to completely meet around the circumference of the pole.

A region on the inside of the protector can be filled with adhesive/glue to provide further securement to the pole, and additional resistance against uplift. The clamshell/coupling is not a perfect circular shape, and is typically a bit undersized. The cable ties "cinching" up pulls the guard around the surface of the pole. This allows the product to be range taking as the pole circumference will be many different sizes, based on the diameter of the pole. The poles are tapered from smaller on top to larger on bottom, which mean the circumference will not always be consistent.

An extra plastic plaque, up to 2" wide or so can be inserted into the slot, to finish off full above ground pole coverage. The fasteners press and secure them in place. Add/slide in plastic plaque for additional above ground sidewall coverage. Add hole that allows glue or adhesive to fill air gap, providing further securement to the pole and resistance against uplift. To install, drive blade into ground on either side of pole using nail head features, to where the fastener slots line up with each other. (The tapered edge and shovel blade design will force the guard along the sidewall keeping it pressed to the pole. Use fasteners to tighten the guard against the pole. Fill holes in top of nail head with adhesive (optional). You can also add adhesive on the side wall of the pole prior to installing the guard for additional adhesion/securement.

In a third aspect, in addition to one or more of the preceding or following aspects, or in the alternative to some aspects, the first and second protective portions include pegs for installation.

In a fourth aspect, in addition to one or more of the preceding or following aspects, or in the alternative to some aspects, the pegs include a port for addition of an adhesive.

In a fifth aspect, in addition to one or more of the preceding or following aspects, or in the alternative to some aspects, the first and second protective portions include receivers for fasteners.

In a sixth aspect, in addition to one or more of the preceding or following aspects, or in the alternative to some aspects, wherein each of the first and second protective portions include two receivers for fasteners.

In a seventh aspect, in addition to one or more of the preceding or following aspects, or in the alternative to some aspects, the receivers for the fasteners have an open vertical dimension larger than the fastener width.

In an eighth aspect, in addition to one or more of the preceding or following aspects, or in the alternative to some aspects, the first and second protective portions include internal recesses for receiving an insert.

In a ninth aspect, in addition to one or more of the preceding or following aspects, or in the alternative to some aspects, the insert expands the circumference of the protective covers.

In a tenth aspect, in addition to one or more of the preceding or following aspects, or in the alternative to some aspects, the insert has a width of less than 2 inches.

In an eleventh aspect, in addition to one or more of the preceding or following aspects, or in the alternative to some aspects, the first and second portions include protrusions on the lower outside for securing into the ground.

In a twelfth aspect, in addition to one or more of the preceding or following aspects, or in the alternative to some aspects, the first and second portions include multiple protrusions on the lower outside for securing into the ground.

In a thirteenth aspect, in addition to one or more of the preceding or following aspects, or in the alternative to some aspects, the first and second portions are concave.

In a fourteenth aspect, in addition to one or more of the preceding or following aspects, or in the alternative to some aspects, the first and second portions are hemispherical.

In a fifteenth aspect, in addition to one or more of the preceding or following aspects, or in the alternative to some aspects, the first and second portions are mirrors of one another.

In a sixteenth aspect, in addition to one or more of the preceding or following aspects, or in the alternative to some aspects, the first and second portions include a shovel tip.

In a seventeenth aspect, in addition to one or more of the preceding or following aspects, or in the alternative to some aspects, the shovel tip includes an external taper.

In an eighteenth aspect, a protective cover for a utility pole is included having a first protective portion, and a second protective portion, wherein the first and second protective portions are each substantially hemispherical and combine to surround and protect a pole at the ground interface, wherein each of the first and second protective portions include lower portions containing points, the points configured for driving into the ground to secure the first and second protective portions in the ground.

In a nineteenth aspect, in addition to one or more of the preceding or following aspects, or in the alternative to some aspects, the first and second protective portions include pegs for installation.

In a twentieth aspect, in addition to one or more of the preceding or following aspects, or in the alternative to some aspects, the pegs include a port for addition of an adhesive.

In a twenty-first aspect, in addition to one or more of the preceding or following aspects, or in the alternative to some aspects, the first and second protective portions include receivers for fasteners.

In a twenty-second aspect, in addition to one or more of the preceding or following aspects, or in the alternative to some aspects, wherein each of the first and second protective portions include two receivers for fasteners.

In a twenty-third aspect, in addition to one or more of the preceding or following aspects, or in the alternative to some aspects, the receivers for the fasteners have an open vertical dimension larger than the fastener width.

In a twenty-fourth aspect, in addition to one or more of the preceding or following aspects, or in the alternative to some aspects, the first and second protective portions include internal recesses for receiving an insert.

In a twenty-fifth aspect, in addition to one or more of the preceding or following aspects, or in the alternative to some aspects, the insert expands the circumference of the protective covers.

In a twenty-sixth aspect, in addition to one or more of the preceding or following aspects, or in the alternative to some aspects, the insert has a width of less than 2 inches.

In a twenty-seventh aspect, in addition to one or more of the preceding or following aspects, or in the alternative to some aspects, the first and second portions include protrusions on the lower outside for securing into the ground.

In a twenty-eighth aspect, in addition to one or more of the preceding or following aspects, or in the alternative to some aspects, the first and second portions include multiple protrusions on the lower outside for securing into the ground.

In a twenty-ninth aspect, in addition to one or more of the preceding or following aspects, or in the alternative to some aspects, the first and second portions are concave.

In a thirtieth aspect, in addition to one or more of the preceding or following aspects, or in the alternative to some aspects, the first and second portions are hemispherical.

In a thirty-first aspect, in addition to one or more of the preceding or following aspects, or in the alternative to some aspects, the first and second portions are mirrors of one another.

In a thirty-second aspect, in addition to one or more of the preceding or following aspects, or in the alternative to some aspects, the first and second portions include a shovel tip.

In a thirty-third aspect, in addition to one or more of the preceding or following aspects, or in the alternative to some aspects, the shovel tip includes an external taper.

In a thirty-fourth aspect, in addition to one or more of the preceding or following aspects, or in the alternative to some aspects, the shovel tip includes an internal taper.

In a thirty-fifth aspect, a protective cover for a utility pole is included having a first protective portion, and a second protective portion, wherein the first and second protective portions are each substantially hemispherical and combine to surround and protect a pole at the ground interface, wherein each of the first and second protective portions include lower portions containing points, the points configured for driving into the ground to secure the first and second protective portions in the ground, wherein each of the first and second protective portions include two receivers for fasteners.

In a thirty-sixth aspect, in addition to one or more of the preceding or following aspects, or in the alternative to some aspects, the first and second protective portions include pegs for installation.

In a thirty-seventh aspect, in addition to one or more of the preceding or following aspects, or in the alternative to some aspects, the pegs include a port for addition of an adhesive.

In a thirty-eighth aspect, in addition to one or more of the preceding or following aspects, or in the alternative to some aspects, the first and second protective portions include receivers for fasteners.

In a thirty-ninth aspect, in addition to one or more of the preceding or following aspects, or in the alternative to some aspects, the receivers for the fasteners have an open vertical dimension larger than the fastener width.

In a fortieth aspect, in addition to one or more of the preceding or following aspects, or in the alternative to some aspects, the first and second protective portions include internal recesses for receiving an insert.

In a forty-first aspect, in addition to one or more of the preceding or following aspects, or in the alternative to some aspects, the insert expands the circumference of the protective covers.

In a forty-second aspect, in addition to one or more of the preceding or following aspects, or in the alternative to some aspects, the insert has a width of less than 2 inches.

In a forty-third aspect, in addition to one or more of the preceding or following aspects, or in the alternative to some aspects, the first and second portions include protrusions on the lower outside for securing into the ground.

In a forty-fourth aspect, in addition to one or more of the preceding or following aspects, or in the alternative to some aspects, the first and second portions include multiple protrusions on the lower outside for securing into the ground.

In a forty-fifth aspect, in addition to one or more of the preceding or following aspects, or in the alternative to some aspects, the first and second portions are concave.

In a forty-sixth aspect, in addition to one or more of the preceding or following aspects, or in the alternative to some aspects, the first and second portions are hemispherical.

In a forty-seventh aspect, in addition to one or more of the preceding or following aspects, or in the alternative to some aspects, the first and second portions are mirrors of one another.

In a forty-eighth aspect, in addition to one or more of the preceding or following aspects, or in the alternative to some aspects, the first and second portions include a shovel tip.

In a forty-ninth aspect, in addition to one or more of the preceding or following aspects, or in the alternative to some aspects, the shovel tip includes an external taper.

In a fiftieth aspect, a protective cover for a utility pole is included having a first protective portion, and a second protective portion, wherein the first and second protective portions are each substantially hemispherical and combine to surround and protect a pole at the ground interface, wherein each of the first and second protective portions include lower portions containing points, the points configured for driving into the ground to secure the first and second protective portions in the ground, and wherein the first and second portions include multiple protrusions on the lower outside for securing into the ground.

In a fifty-first aspect, in addition to one or more of the preceding or following aspects, or in the alternative to some aspects, the first and second protective portions include pegs for installation.

In a fifty-second aspect, in addition to one or more of the preceding or following aspects, or in the alternative to some aspects, the pegs include a port for addition of an adhesive.

In a fifty-third aspect, in addition to one or more of the preceding or following aspects, or in the alternative to some aspects, the first and second protective portions include receivers for fasteners.

In a fifty-fourth aspect, in addition to one or more of the preceding or following aspects, or in the alternative to some aspects, the receivers for the fasteners have an open vertical dimension larger than the fastener width.

In a fifty-fifth aspect, in addition to one or more of the preceding or following aspects, or in the alternative to some aspects, the first and second protective portions include internal recesses for receiving an insert.

In a fifty-sixth aspect, in addition to one or more of the preceding or following aspects, or in the alternative to some aspects, the insert expands the circumference of the protective covers.

In a fifty-seventh aspect, in addition to one or more of the preceding or following aspects, or in the alternative to some aspects, the insert has a width of less than 2 inches.

In a fifty-eighth aspect, in addition to one or more of the preceding or following aspects, or in the alternative to some aspects, the first and second portions include protrusions on the lower outside for securing into the ground.

In a fifty-ninth aspect, in addition to one or more of the preceding or following aspects, or in the alternative to some aspects, the first and second portions include multiple protrusions on the lower outside for securing into the ground.

In a sixtieth aspect, in addition to one or more of the preceding or following aspects, or in the alternative to some aspects, the first and second portions are concave.

In a sixty-first aspect, in addition to one or more of the preceding or following aspects, or in the alternative to some aspects, the first and second portions are hemispherical.

In a sixty-second aspect, in addition to one or more of the preceding or following aspects, or in the alternative to some aspects, the first and second portions are mirrors of one another.

In a sixty-third aspect, in addition to one or more of the preceding or following aspects, or in the alternative to some aspects, the first and second portions include a shovel tip.

In a sixty-fourth aspect, in addition to one or more of the preceding or following aspects, or in the alternative to some aspects, the shovel tip includes an external taper.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope herein is defined by the appended claims and their legal equivalents.

BRIEF DESCRIPTION OF THE FIGURES

Aspects may be more completely understood in connection with the following figures (FIGS.), in which.

While embodiments are susceptible to various modifications and alternative forms, specifics thereof have been shown by way of example and drawings and will be described in detail. It should be understood, however, that the scope herein is not limited to the particular aspects described. On the contrary, the intention is to cover modifications, equivalents, and alternatives falling within the spirit and scope herein.

DETAILED DESCRIPTION

Figure 1:
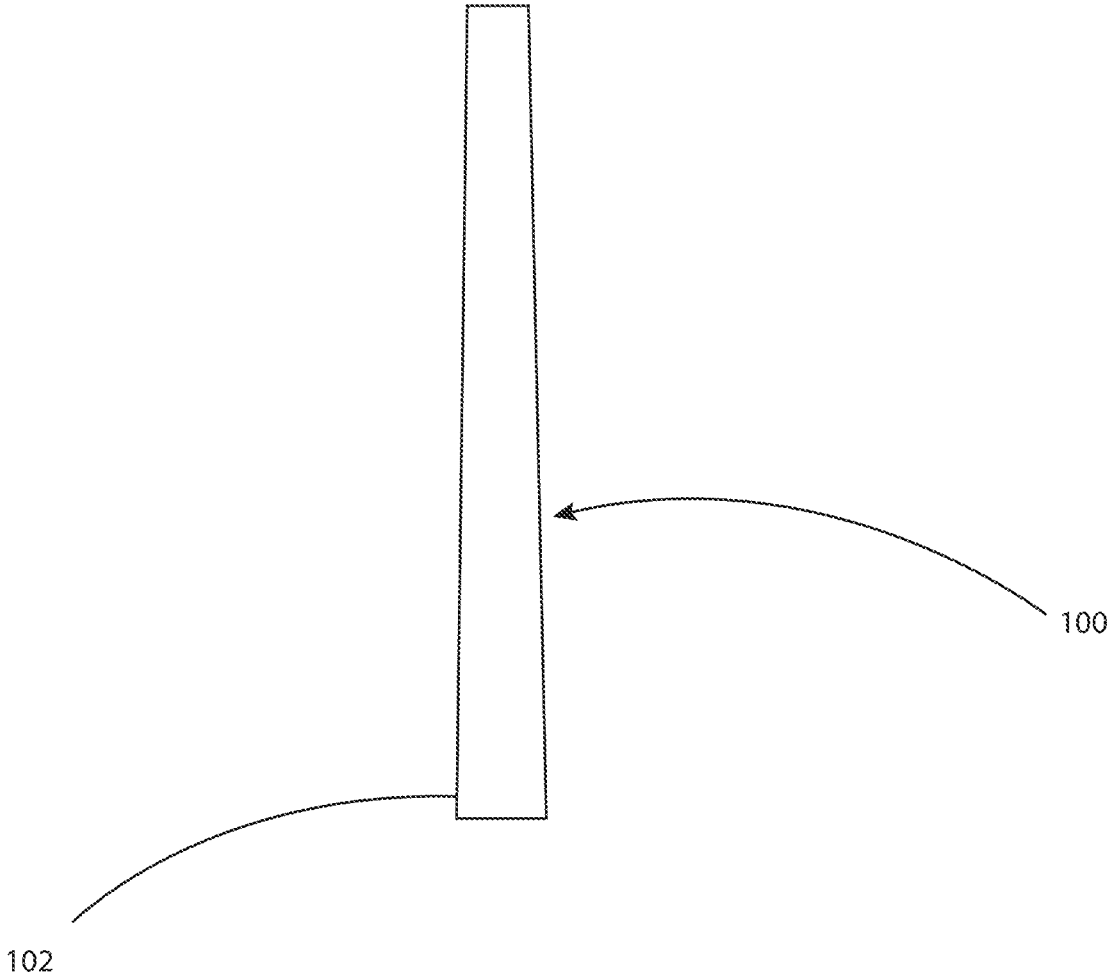
FIG. 1 is an image showing a light pole installed in grass adjacent to walking paths.

Aspects may be more completely understood in connection with the following figures (FIGS.), in which:

FIG. 1 is an image showing a pole 100 (typically a light pole, but optionally a pole for other purposes, such as wireless access point, etc.). installed in grass 102 adjacent to walking paths. The pole 100 continues into the ground and the base of the pole 100 is exposed to tools that are used to mow the grass, such as weed trimmers and lawn mowers, which can cause damage to the pole.

Figure 2:
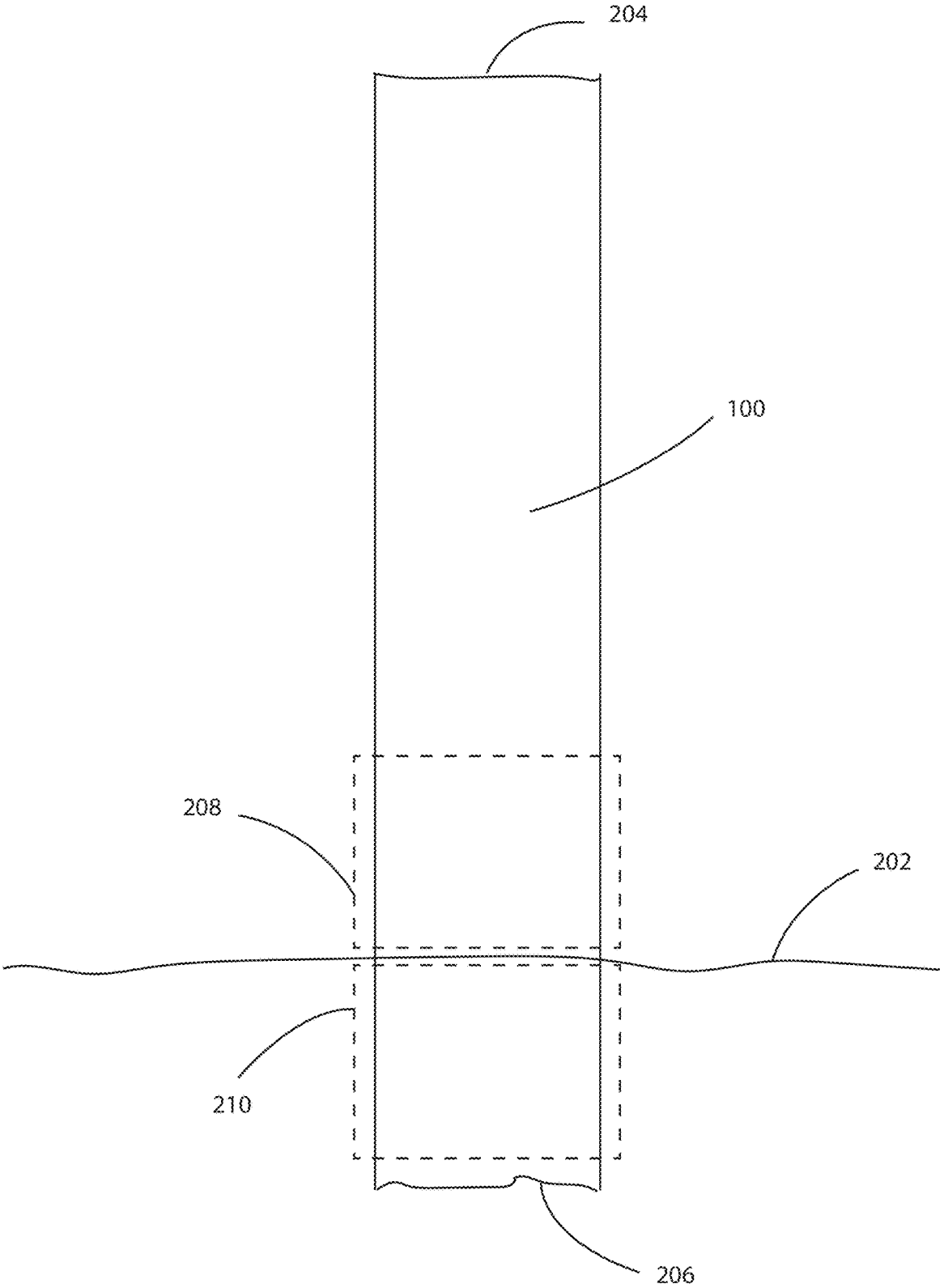
FIG. 2 is simplified drawing showing lower portions of a pole at the ground interface, showing regions above and below the pole.

FIG. 2 is simplified drawing showing a pole 100 with upper section 204 (drawn in partial view)) and lower section 206 (drawn in partial view); with lower portions of a pole 100 at the ground interface 202, showing above ground region 208 above and below ground region 210.

Figure 3:
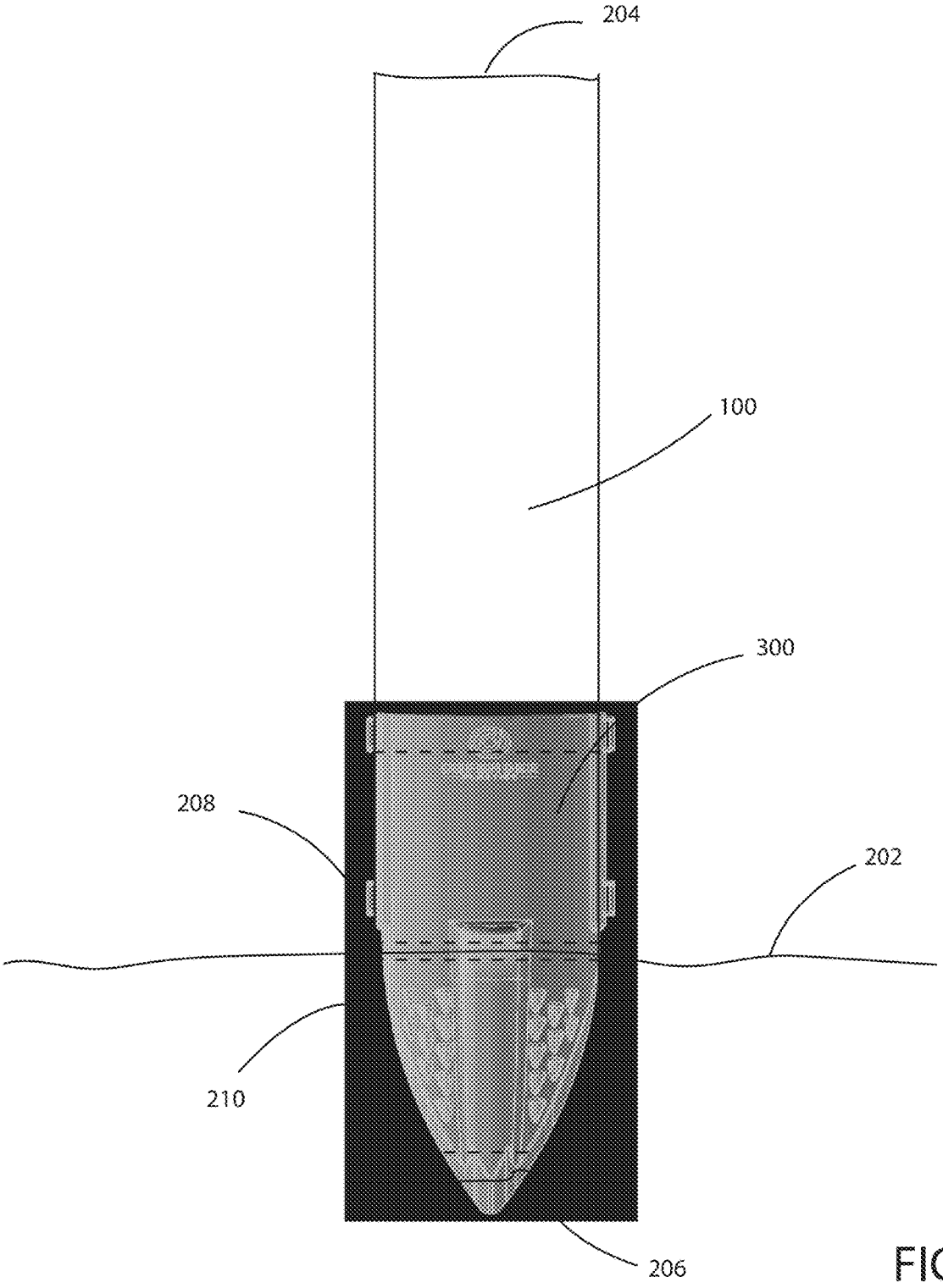
FIG. 3 is a drawing depicting a pole protector installed at the ground interface, in accordance with various embodiments herein.

FIG. 3 is a drawing depicting a pole protector 300 installed at ground interface 202, in accordance with various embodiments herein. The pole protector 300 is attached to the pole 100 (shown in outline view). Typically, two pole protectors 300 are installed, with the pole protectors 300 wrapping around the circumference of the pole 100 so as to provide full protection around the base of the pole 100. In addition, the protection is primarily above ground, but is also in some instances partially below ground. Typical above ground coverage is around 3 to 6 inches above ground, with below ground coverage being partial protection also to about 3 to 6 inches, with full protection (360 degrees) being less, such as around 1 to 2 inches. It will be understood that the extent of protection can vary depending upon terrain, and also that various size pole protectors are possible. In addition, as it is possible for ground levels to change (such as addition of mulch or soil around the pole to raise ground levels, or reduction in ground levels from subsidence or erosion. Thus, it is generally desirable to have the protection extend at least part way below the ground to allow for changes in ground height.

Figure 4:
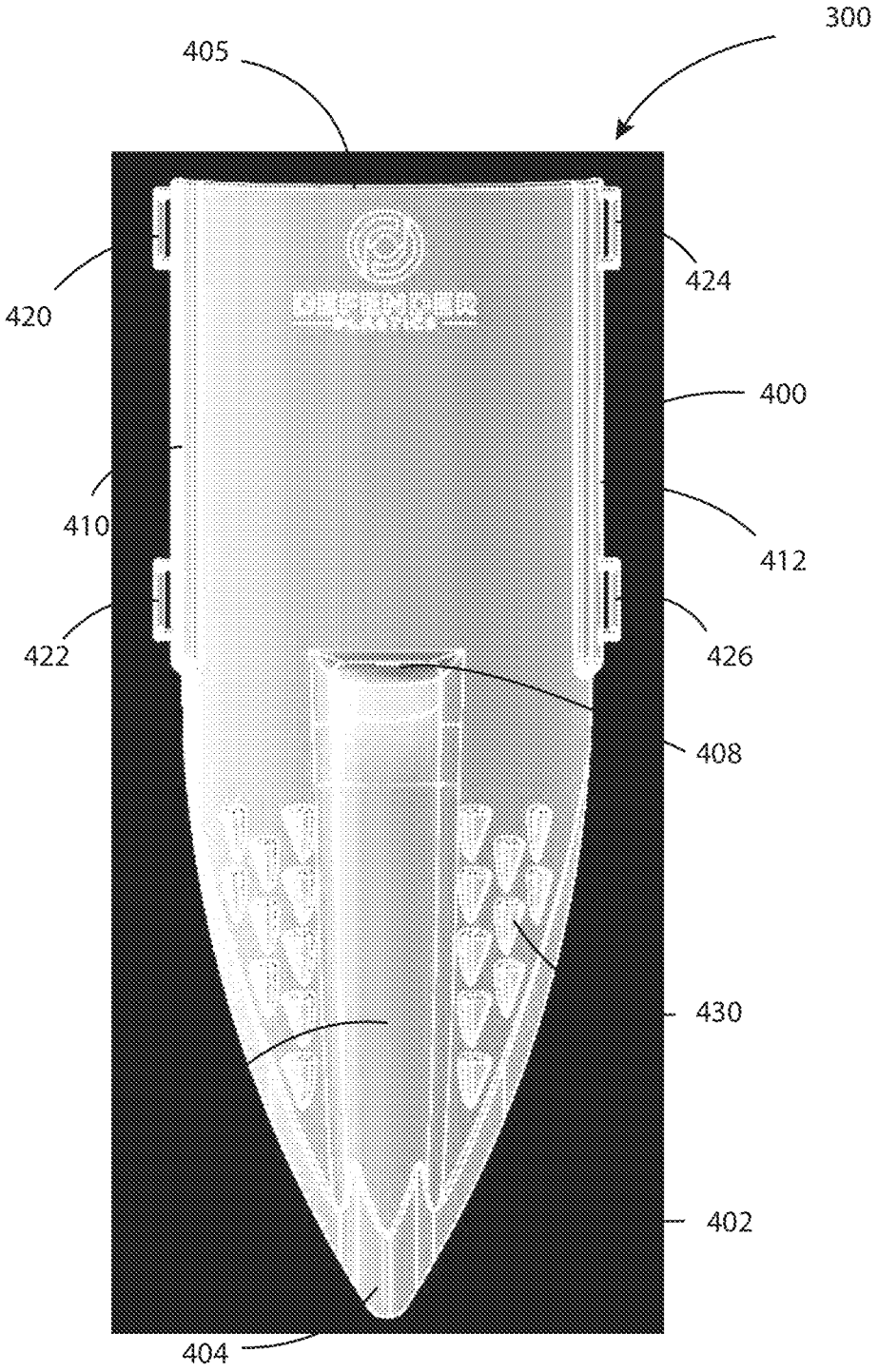
FIG. 4 is a is a front view of a pole protector in accordance with various embodiments herein.
Figure 5:
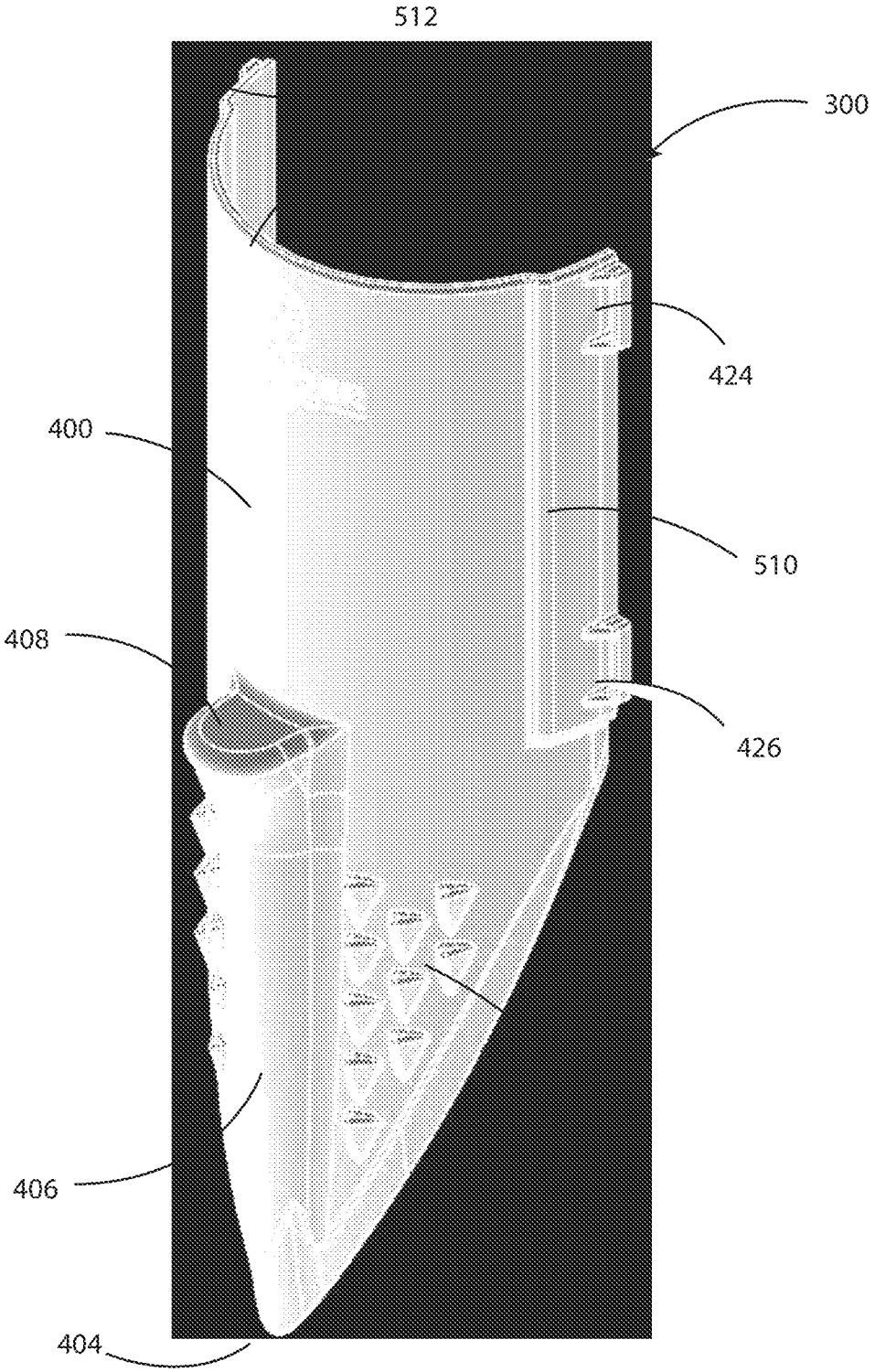
FIG. 5 is a perspective view of a pole protector in accordance with various embodiments herein.

FIG. 4 is a is a front view of a pole protector 300 in accordance with various embodiments herein, and FIG. 5 is a perspective view of the pole protector 300 made in accordance with various embodiments herein. The pole protector 300 includes an above ground portion 400 and tapered lower edge 402 that fits below ground, a lower tip 404 and an upper lip 405. The protector 300 includes a first edge 410 and a second edge 412. The first edge 410 and second edge 412 are configured to extend next to adjacent edges of other adjacent pole protectors. The protector 300 also includes pairs of receivers for fasteners, specifically first upper receiver 420 and first lower receiver 422; and second upper receiver 424 and second lower receiver 426. The upper and lower receivers pair with corresponding upper and lower receivers on a second protector. The pole protector 300 includes protrusions 430 which help to secure the pole protector in the ground and prevent it from slipping back upward. A reinforcing rib 406 extends out from the lower portion of the pole protector 300 and includes an upper contact surfaces 408 for pushing down with an installer's foot or a tool to drive the pole protector 300 into the ground around a pole. As shown in FIG. 5, the pole protector 300 includes, in certain embodiments, a slot for insertion of an expansion piece to allow for the pole protector to fit a plurality of sizes of poles, as described below. The slot as depicted in FIG. 5 includes an external raised portion 510 and an internal recessed portion 512. The internal recessed portion 512.

Figure 6:
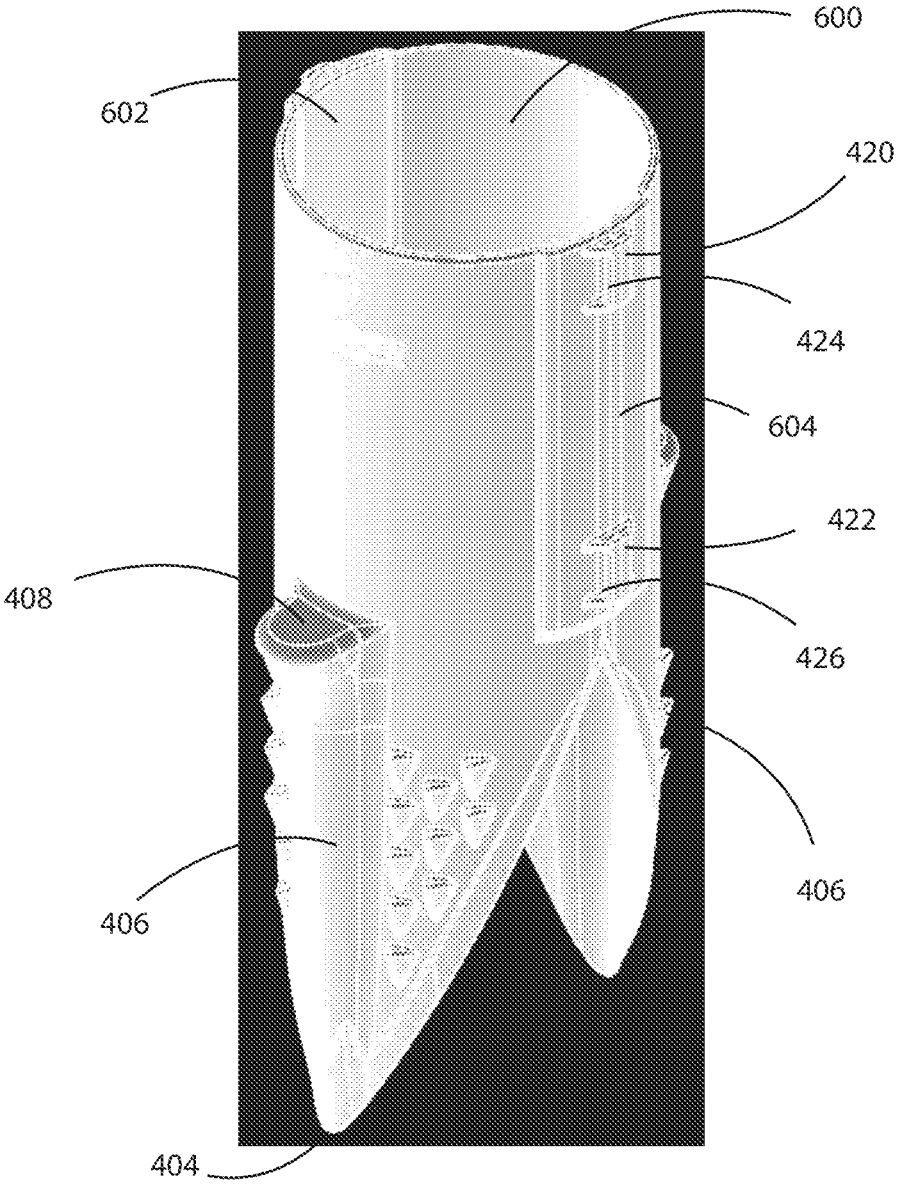
FIG. 6 is a is a perspective view of two combined pole protectors in accordance with various embodiments herein.

FIG. 6 is a is a perspective view of two combined pole protectors in accordance with various embodiments herein. The pole protectors 300 each include an interior 600 as well as (in this embodiment) an insert 602. The pole protectors 300 further include tapered lower edges 402, a lower tip 404 and an upper lip 405. The protector 300 includes a first edge 410 and a second edge 412. The first edge 410 and second edge 412 are configured to extend next to adjacent edges of other adjacent pole protectors. The protector 300 also includes pairs of receivers for fasteners, specifically first upper receiver 420 and first lower receiver 422; and second upper receiver 424 and second lower receiver 426. The pole protector 300 includes protrusions 430 which help to secure the pole protector in the ground and prevent it from slipping back upward. A reinforcing rib 406 extends out from the lower portion of the pole protector 300 and includes an upper contact surfaces 408 for pushing down with an installer's foot or a tool to drive the pole protector 300 into the ground around a pole. The pole protectors optionally converge at junction 604. Also, in the embodiment shown the pole protectors 300 include a sharp edge 610 able to cut into the ground.

Figure 7:
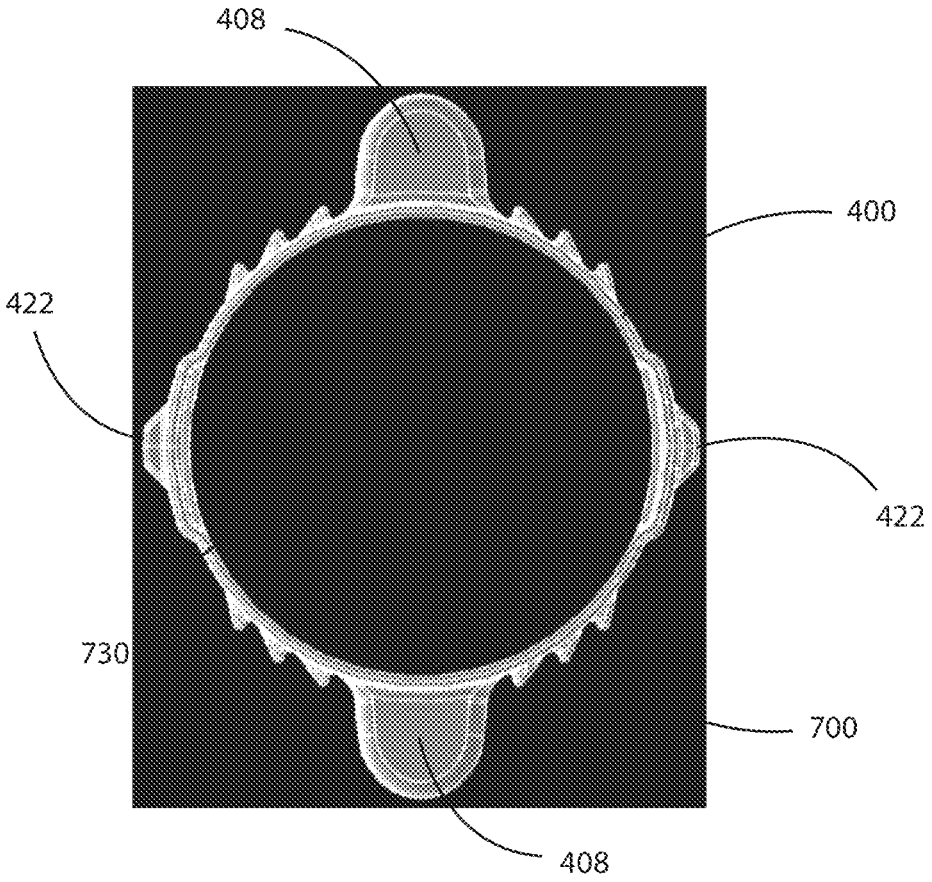
FIG. 7 is a top plan view of two combined pole protectors in accordance with various embodiments herein.

FIG. 7 is a top plan view of two combined pole protectors in accordance with various embodiments herein. Upper contact surfaces 408 are shown opposed to one another, forming a surrounded interior 730 that is protected by the pole protectors (and is where the pole is located).

Figure 8:
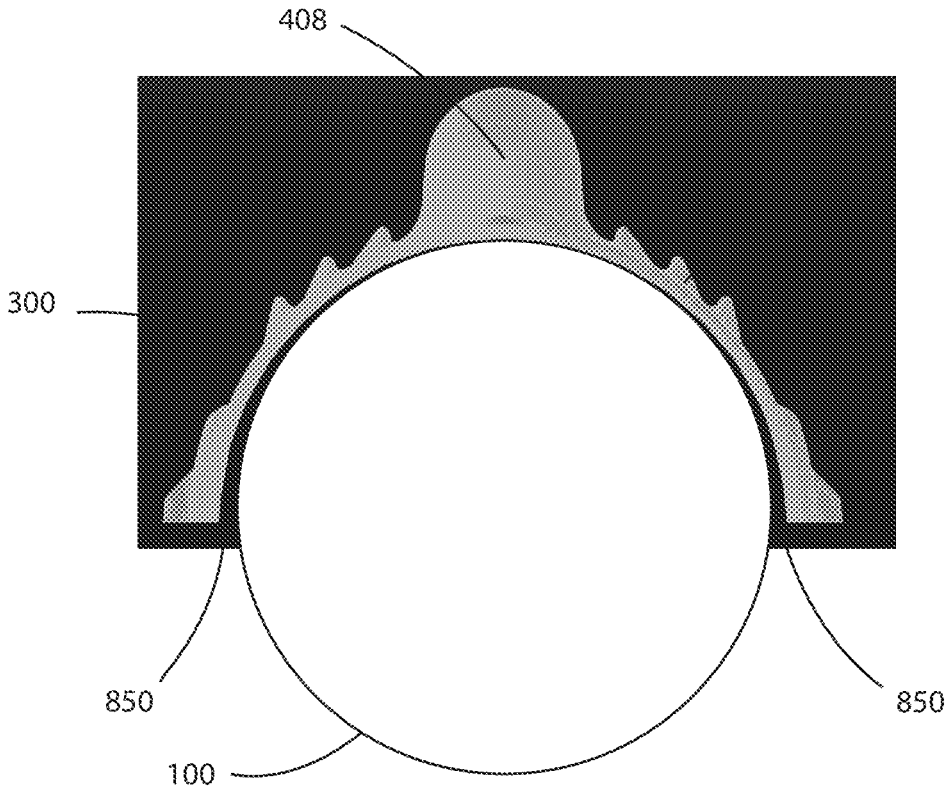
FIG. 8 is a top view of pole protector in accordance with various embodiments herein.

FIG. 8 is a top view of pole protector 300 in accordance with various embodiments herein. FIG. 8 shows how the protector 300 often has a gap 850 relative to a standard circle, and thus the pole protector 300 is flared open to a certain extent, allowing the pole protector 300 to conform to multiple sizes of poles. Fasteners and adhesive can be used to close the gap 850 to snug the pole protector 300 against a pole.

Figure 10:
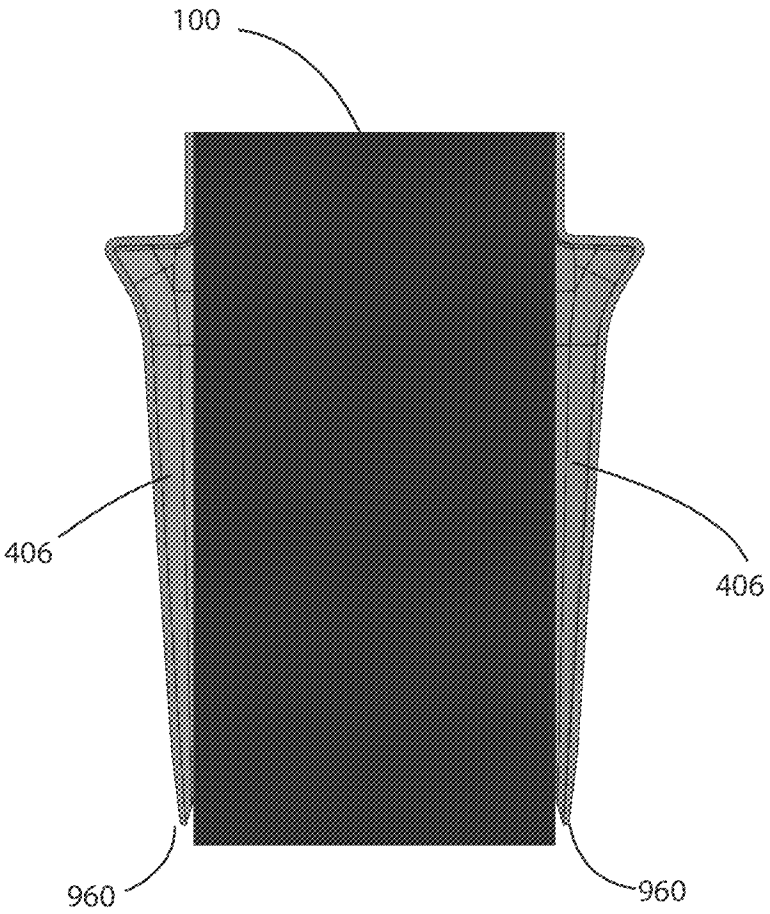
FIG. 10 is a side cross-sectional view of the two combined pole protectors of FIG. 9.
Figure 9:
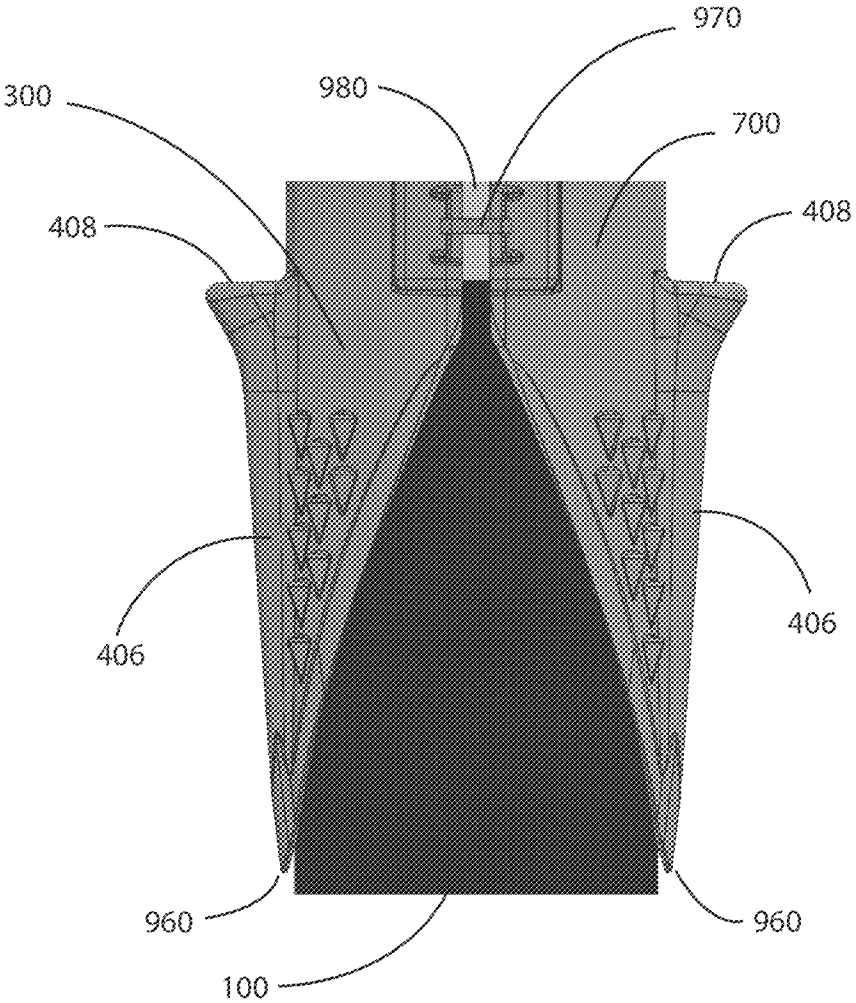
FIG. 9 is a side elevational view of two combined pole protectors in accordance with various embodiments herein.

FIG. 9 is a side elevational view of two combined pole protectors in accordance with various embodiments herein. FIG. 10 is a side cross-sectional view of the two combined pole protectors of FIG. 9. A fastener 970 is shown securing the pole protectors 300, 700 together, the fastener 970 securing a gap guard 980. The gap guard 980 is able to slide within a gap between the pole protectors 300, 700 to conform to various diameters of poles. The pole protectors 300, 700 include tapered lower edges 402, a lower tip 404 and an upper lip 405. The protector 300 includes a first edge 410 and a second edge 412. The first edge 410 and second edge 412 are configured to extend next to adjacent edges of other adjacent pole protectors. The protector 300 also includes pairs of receivers for fasteners, specifically first upper receiver 420 and first lower receiver 422; and second upper receiver 424 and second lower receiver 426. The pole protector 300 includes protrusions 430 which help to secure the pole protector in the ground and prevent it from slipping back upward. A reinforcing rib 406 extends out from the lower portion of the pole protector 300, and includes an upper contact surfaces 408 for pushing down with an installer's foot or a tool to drive the pole protector 300 into the ground around a pole. A tip 960 is shown in FIG. 9.

Figure 12:
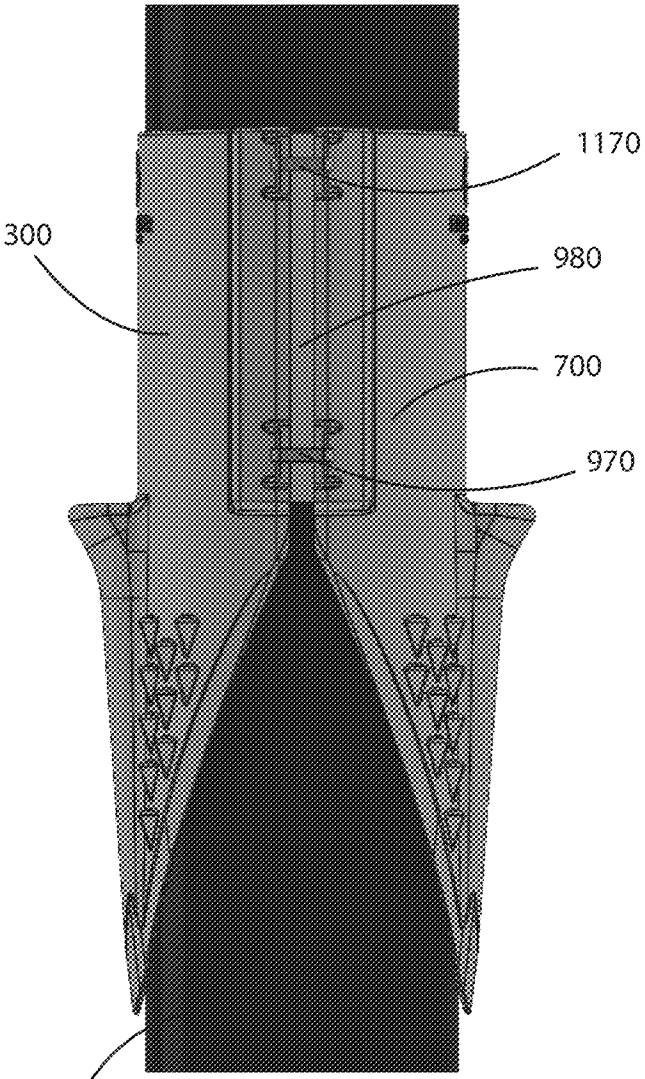
FIG. 12 is a front elevational view of the two combined pole protectors of FIG. 11.
Figure 11:
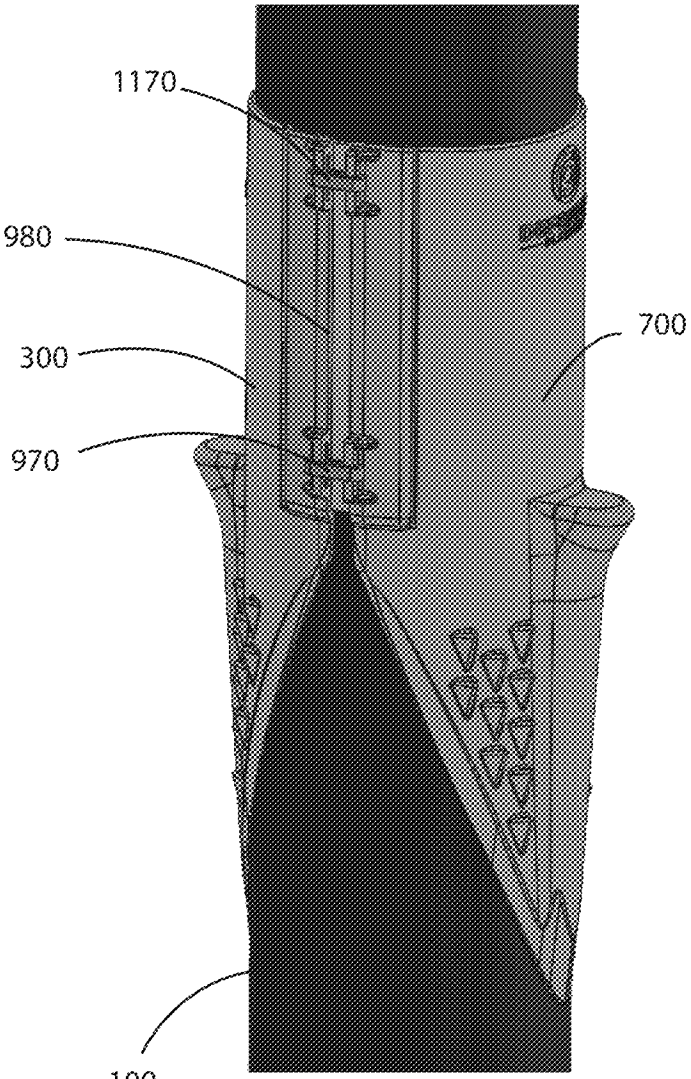
FIG. 11 is a perspective view of two of two combined pole protectors in accordance with various embodiments herein, shown installed on a pole.
Figure 13:
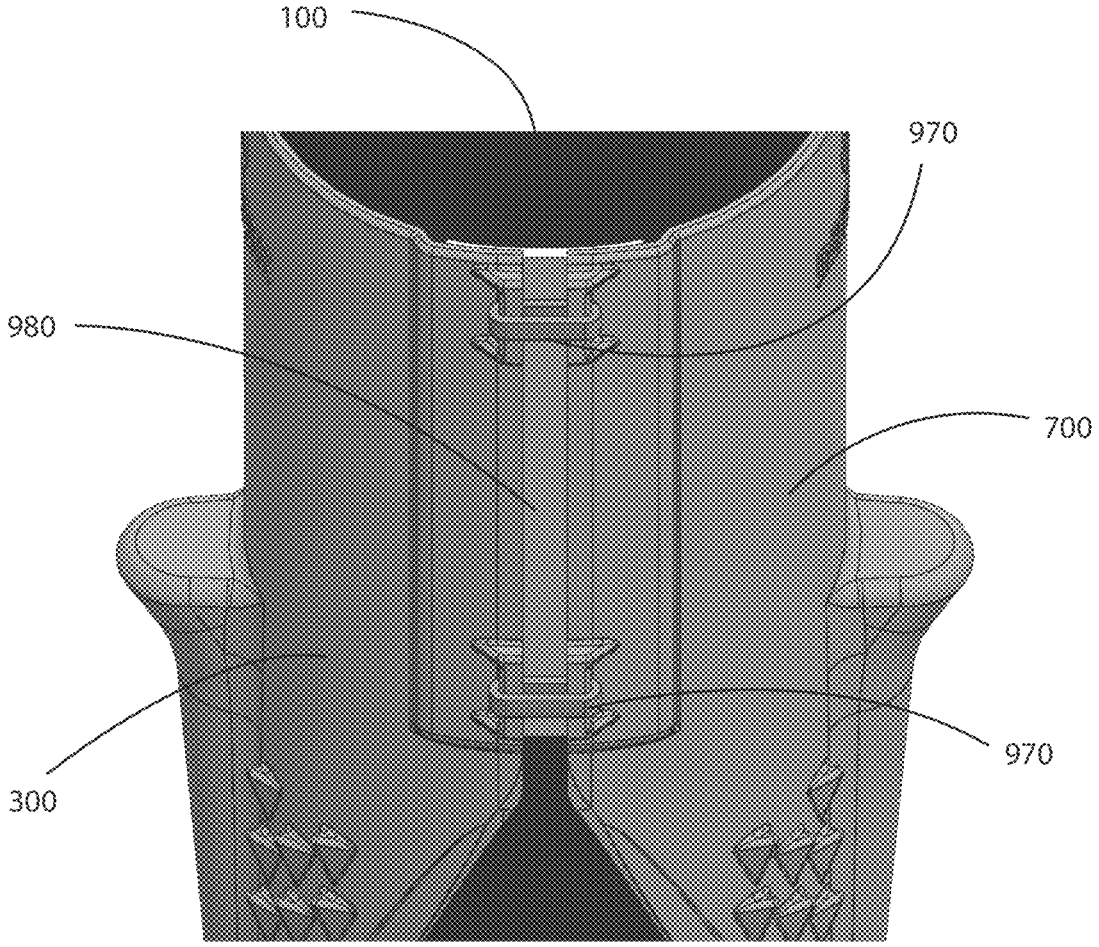
FIG. 13 is a closeup perspective view of two combined pole protectors in accordance with various embodiments herein, shown installed on a pole.

FIG. 11 is a perspective view of two of two combined pole protectors in accordance with various embodiments herein, shown installed on a pole. FIG. 12 is a front elevational view of the two combined pole protectors of FIG. 11. FIG. 13 is a closeup perspective view of two combined pole protectors in accordance with various embodiments herein, shown installed on a pole. A fastener 1170 is shown securing the pole protectors 300 together, in particular while any adhesive cures to hold the pole protectors 300 to the pole.

Further, the present subject matter is directed to:

In an embodiment, a protective cover for a utility pole is included having a first protective portion, and a second protective portion, wherein the first and second protective portions are each substantially hemispherical and combine to surround and protect a pole at the ground interface.

In an embodiment, wherein each of the first and second protective portions include lower portions containing points, the points configured for driving into the ground to secure the first and second protective portions in the ground.

In an embodiment, the first and second protective portions include pegs for installation.

In an embodiment, the pegs include a port for addition of an adhesive.

In an embodiment, the first and second protective portions include receivers for fasteners.

In an embodiment, wherein each of the first and second protective portions include two receivers for fasteners.

In an embodiment, the receivers for the fasteners have an open vertical dimension larger than the fastener width.

In an embodiment, the first and second protective portions include internal recesses for receiving an insert.

In an embodiment, the insert expands the circumference of the protective covers.

In an embodiment, the insert has a width of less than 2 inches.

In an embodiment, the first and second portions include protrusions on the lower outside for securing into the ground.

In an embodiment, the first and second portions include multiple protrusions on the lower outside for securing into the ground.

In an embodiment, the first and second portions are concave.

In an embodiment, the first and second portions are hemispherical.

In an embodiment, the first and second portions are mirrors of one another.

In an embodiment, the first and second portions include a shovel tip.

In an embodiment, the shovel tip includes an external taper.

In an embodiment, a protective cover for a utility pole is included having a first protective portion, and a second protective portion, wherein the first and second protective portions are each substantially hemispherical and combine to surround and protect a pole at the ground interface, wherein each of the first and second protective portions include lower portions containing points, the points configured for driving into the ground to secure the first and second protective portions in the ground.

In an embodiment, the first and second protective portions include pegs for installation.

In an embodiment, the pegs include a port for addition of an adhesive.

In an embodiment, the first and second protective portions include receivers for fasteners.

In an embodiment, wherein each of the first and second protective portions include two receivers for fasteners.

In an embodiment, the receivers for the fasteners have an open vertical dimension larger than the fastener width.

In an embodiment, the first and second protective portions include internal recesses for receiving an insert.

In an embodiment, the insert expands the circumference of the protective covers.

In an embodiment, the insert has a width of less than 2 inches.

In an embodiment, the first and second portions include protrusions on the lower outside for securing into the ground.

In an embodiment, the first and second portions include multiple protrusions on the lower outside for securing into the ground.

In an embodiment, the first and second portions are concave.

In an embodiment, the first and second portions are hemispherical.

In an embodiment, the first and second portions are mirrors of one another.

In an embodiment, the first and second portions include a shovel tip.

In an embodiment, the shovel tip includes an external taper.

In an embodiment, the shovel tip includes an internal taper.

In an embodiment, a protective cover for a utility pole is included having a first protective portion, and a second protective portion, wherein the first and second protective portions are each substantially hemispherical and combine to surround and protect a pole at the ground interface, wherein each of the first and second protective portions include lower portions containing points, the points configured for driving into the ground to secure the first and second protective portions in the ground, wherein each of the first and second protective portions include two receivers for fasteners.

In an embodiment, the first and second protective portions include pegs for installation.

In an embodiment, the pegs include a port for addition of an adhesive.

In an embodiment, the first and second protective portions include receivers for fasteners.

In an embodiment, the receivers for the fasteners have an open vertical dimension larger than the fastener width.

In an embodiment, the first and second protective portions include internal recesses for receiving an insert.

In an embodiment, the insert expands the circumference of the protective covers.

In an embodiment, the insert has a width of less than 2 inches.

In an embodiment, the first and second portions include protrusions on the lower outside for securing into the ground.

In an embodiment, the first and second portions include multiple protrusions on the lower outside for securing into the ground.

In an embodiment, the first and second portions are concave.

In an embodiment, the first and second portions are hemispherical.

In an embodiment, the first and second portions are mirrors of one another.

In an embodiment, the first and second portions include a shovel tip.

In an embodiment, the shovel tip includes an external taper.

In an embodiment, a protective cover for a utility pole is included having a first protective portion, and a second protective portion, wherein the first and second protective portions are each substantially hemispherical and combine to surround and protect a pole at the ground interface, wherein each of the first and second protective portions include lower portions containing points, the points configured for driving into the ground to secure the first and second protective portions in the ground, and wherein the first and second portions include multiple protrusions on the lower outside for securing into the ground.

In an embodiment, the first and second protective portions include pegs for installation.

In an embodiment, the pegs include a port for addition of an adhesive.

In an embodiment, the first and second protective portions include receivers for fasteners.

In an embodiment, the receivers for the fasteners have an open vertical dimension larger than the fastener width.

In an embodiment, the first and second protective portions include internal recesses for receiving an insert.

In an embodiment, the insert expands the circumference of the protective covers.

In an embodiment, the insert has a width of less than 2 inches.

In an embodiment, the first and second portions include protrusions on the lower outside for securing into the ground.

In an embodiment, the first and second portions include multiple protrusions on the lower outside for securing into the ground.

In an embodiment, the first and second portions are concave.

In an embodiment, the first and second portions are hemispherical.

In an embodiment, the first and second portions are mirrors of one another.

In an embodiment, the first and second portions include a shovel tip.

In an embodiment, the shovel tip includes an external taper.

It should be noted that, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

As used herein, the recitation of numerical ranges by endpoints shall include all numbers subsumed within that range (e.g., 2 to 8 includes 2.1, 2.8, 5.3, 7, etc.).

The headings used herein are provided for consistency with suggestions under 37 CFR 1.77 or otherwise to provide organizational cues. These headings shall not be viewed to limit or characterize the invention(s) set out in any claims that may issue from this disclosure. As an example, although the headings refer to a "Field," such claims should not be limited by the language chosen under this heading to describe the so-called technical field. Further, a description of a technology in the "Background" is not an admission that technology is prior art to any invention(s) in this disclosure. Neither is the "Summary" to be considered as a characterization of the invention(s) set forth in issued claims.

The embodiments described herein are not intended to be exhaustive or to limit the invention to the precise forms disclosed in the following detailed description. Rather, the embodiments are chosen and described so that others skilled in the art can appreciate and understand the principles and practices. As such, aspects have been described with reference to various specific and preferred embodiments and techniques. However, it should be understood that many variations and modifications may be made while remaining within the spirit and scope herein.

The invention claimed is:

1. A protective cover for a utility pole comprising:

a first pole protector; and a second pole protector;

wherein the first and second pole protectors are each substantially hemispherical and combine to surround and protect a pole at the ground interface;

wherein each of the first and second pole protectors comprise lower portions containing points, the points configured for driving into the ground to secure the first and second protective portions in the ground;

wherein the first and second pole protectors comprise reinforcing ribs for installation;

a first gap guard and a second gap guard, the first and second gap guards configured to slide within a gap between the pole protectors to conform to various pole diameters;

protrusions on the pole protectors to secure the pole protector in the ground and prevent it from slipping back upward;

each of the reinforcing ribs extending out form a lower portion of the pole protector includes an upper contact surface for pushing down during installation to drive the pole protector into the ground;

wherein each of the first and second pole protectors comprise two receivers for fasteners, such that when fasteners are installed they are positioned over the first gap guard and second gap guard and link the first pole protector to the second pole protector, with a gap guard located between the pole protectors and beneath the fasteners;

wherein the receivers for the fasteners have an open vertical dimension larger than width of the fastener;

wherein the first and second pole protectors are each substantially hemispherical and combine with the first gap guard and second gap guard to surround and protect a pole at the ground interface such that a portion of pole is exclusively covered by the first pole protector, a portion of the pole is exclusively covered by the second pole protector, a portion of the pole is exclusively covered by the first gap guard; and a portion of the pole is exclusively covered by the second gap guard.

2. The protective cover for a utility pole of claim 1, wherein the first and second pole protectors comprise protrusions on the lower outside for securing into the ground.

* * * * *